US005154384A

United States Patent [19]

Owens

[11] Patent Number: 5,154,384

[45] Date of Patent: Oct. 13, 1992

[54] CORNER HANGER

[76] Inventor: Patricia J. Owens, 202 Ridgewood Ave., Clewiston, Fla. 33440

[21] Appl. No.: 483,088

[22] Filed: Feb. 16, 1990

[51] Int. Cl.[5] ..... A47F 5/00

[52] U.S. Cl. ..... 248/220.1

[58] Field of Search ..... 248/220.1, 200.1, 258, 248/270, 323, 497, 498

[56] References Cited

U.S. PATENT DOCUMENTS

| | | | |
|---|---|---|---|
| 150,230 | 4/1874 | Dobbs et al. | 248/217.2 X |
| 814,811 | 3/1906 | Speed | 248/220.1 X |
| 1,068,250 | 7/1913 | Koenig | 248/201 |
| 1,296,428 | 3/1919 | Raney | 248/270 |
| 1,325,143 | 12/1919 | Conterio | 248/220.1 X |
| 3,967,805 | 7/1976 | Hoffman | 248/220.1 X |

*Primary Examiner*—David M. Purol
*Assistant Examiner*—Robert A. Olson
*Attorney, Agent, or Firm*—Malin, Haley, McHale DiMaggio & Crosby

[57] ABSTRACT

A device for hanging picture frames, plates, and the like in the corner between walls having means to adjust the axial length of the device and consequently its distance from the corner before being secured to the respective walls. In addition, once the device is secured against the walls of the corner, means are provided to adjustably position the point where plates and the like are hung from the device along a line extending from the corner and through the device at a right angle to the device. Means are also provided to facilitate fastening the device to the walls.

18 Claims, 1 Drawing Sheet

CORNER HANGER

BACKGROUND OF THE INVENTION

1. Field of the Invention

This invention relates to devices for hanging picture frames, plates and the like, from walls, and more particularly to hanging these objects in corners between walls.

2. Description of the Related Art

Devices of various constructions have been patented which allow picture frames, shelving, and toilet articles among other things, to be hung in the corners of walls. Examples of such patents include U.S. Pat. No. 150,230, issued Apr. 28, 1874 to S. Dobbs and W. N. Brayton, U.S. Pat. No. 1,219,025, issued Mar. 13, 1917 to G. W. Mertz, and U.S. Pat. No. 4,727,815, issued Mar. 1, 1988, to Stephen A. Miller. While these devices provide means for hanging objects in a corner, they do not provide means for adjustably positioning the device itself or the object to be hung, with respect to the corner of the wall. As can be seen from the geometry of the situation, a line from one wall in a corner to the corresponding wall, which line also intersects each wall at an equal angle and intersects the hanging device has a distinct length. The closer the device is to the corner, the shorter the line, and vice versa. This length of this line represents the greatest width of a picture or the like that can be supported by such a device which positions the object to be hung next to the device. A picture or the like having a larger width than this, and desiring to intersect both walls at equal angles must necessarily move further from the corner and consequently further from a device rigidly positioned in the corner. Of course, the picture could be turned obliquely to the corner and still contact the device, but such obliquely displayed pictures are not aesthetically pleasing to most people. The prior art devices contain no means for adjusting either their distance or the object to be hung's distance from the corner. This clearly limits these devices, ability to accomodate larger or smaller width pictures or to adjust the device's mounting position on a wall to accomodate studs in the wall and the like. This is clearly a problem in want of a solution.

SUMMARY OF THE INVENTION

The instant device for hanging picture frames, plates, and the like, in the corners between walls has both a means for adjusting the distance the device is placed from a corner, and an adjustable means for attaching the object to be hung to the device so that the object can be moved closer or further away from the corner after the device has been installed.

The device comprises a turnbuckle threadably connected at both ends to beveled end pieces which contact the walls. The end pieces are rigidly connected to threadable rods which in turn interact with the turnbuckle. The beveled end pieces also have apertures through them for driving nails or screws or the like into the walls for securing the end pieces to the walls. An adjustable means for hanging objects is provided perpendicular to the turnbuckle and directed away from the corner. The means for hanging objects is adjustable in this perpendicular direction so that the point connecting the object to be hung to the adjustable means moves closer or further away from the turnbuckle along this perpendicular axis.

Because the two end pieces are only connected through the turnbuckle, the turnbuckle can move the beveled ends away from each other along the linear axis of the turnbuckle, providing the advantage over the prior art that the axial length of the device can be altered from a comparatively short length to a comparatively longer length. This allows the device to be positioned various distances from the corner between the walls, which allows for chosing the anchoring spots of the end pieces as well as determining the size, including the width, of the article that can be hung by such a device.

Another advantage of the instant invention over the prior art is that adjustable means for attaching the object to the turnbuckle is provided. This allows the object to be hung to be adjustably positioned away from the device after it has been installed. Larger objects than those possible without such adjustable means may then be hung.

It is therefore an object of the present invention to provide a device for hanging objects in a corner that is adjustable in the distance the device is placed from the corner of the wall. This accommodates variations in the width of objects to be hung.

It is another object of the invention to provide a device for hanging objects in the corner of a wall that adjustably provides for the object to be hung closer or further from the corner once the device has been positioned.

It is another object of the invention to provide a device for hanging objects from or in the corner that is easy to install.

It is still another object of the invention to provide a device for hanging objects in the corner of a wall that is simple and easy to manufacture.

In accordance with these and other objects which will be apparent hereafter, the instant invention will now be described with particular reference to the accompanying drawings.

DESCRIPTION OF THE PREFERRED EMBODIMENT

Figure 1:
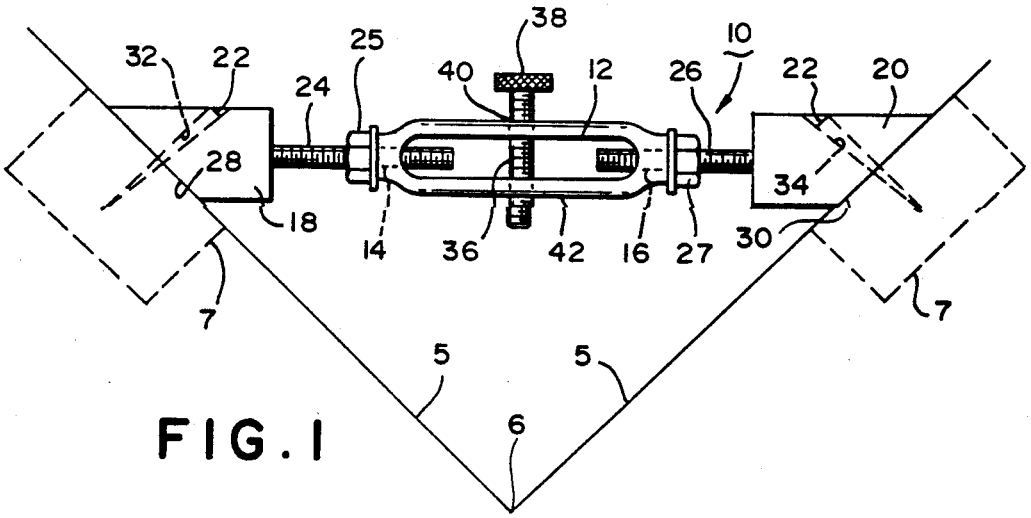
FIG. 1 is a top view of the invention in position near the corner of a wall.
Figure 2:
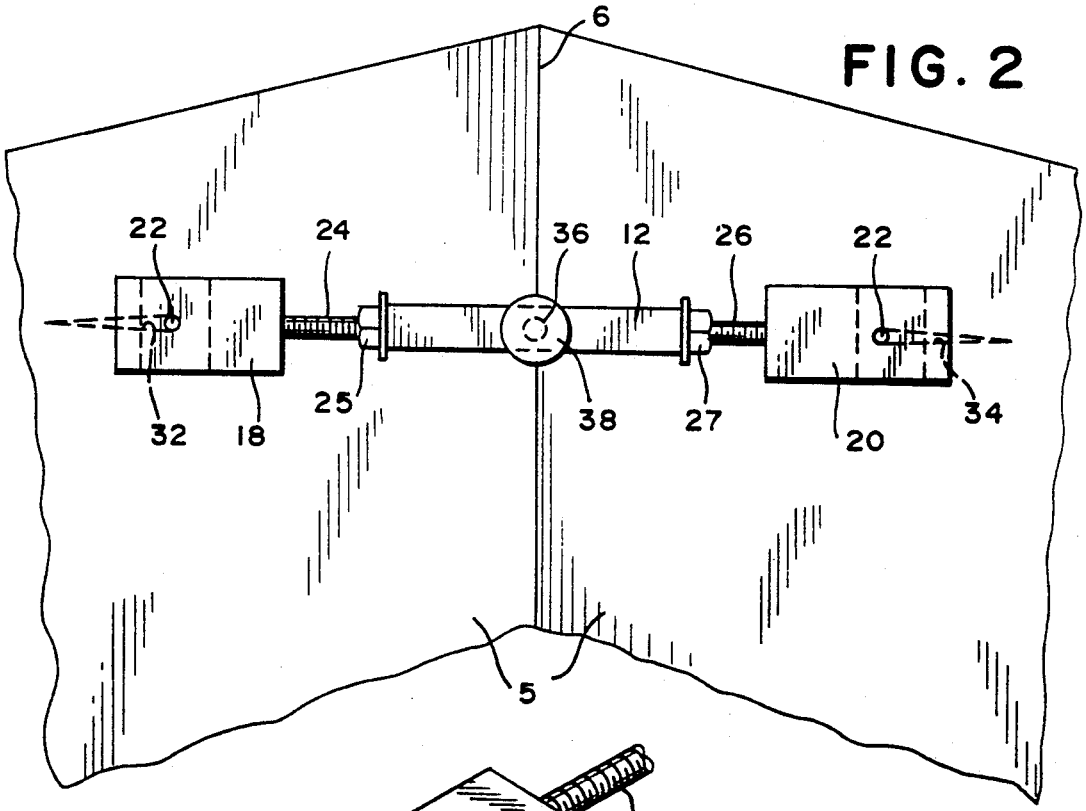
FIG. 2 is a front perspective view of the invention in place near the corner of a wall.

In FIG. 1, the instant invention is generally labeled as 10, in position near the corner 6 of two walls 5. The device comprises a turnbuckle 12 which has two threaded turnbuckle apertures 14 and 16. These two threaded turnbuckle apertures 14, 16 are oppositely threaded, that is, if aperture 14 is threaded with the right handed thread, aperture 16 is threaded with a left handed thread and visa versa. For purposes of the invention, it does not matter in which direction a specific aperture is threaded, so long as the relationship between the direction of threading as just explained is maintained. Threaded rods 24 and 26, having corresponding threading to turn buckle apertures 14 and 16 respectively, threadably intermeshed with turnbuckle apertures 14 and 16. Threaded lock nuts 25 and 27 may be placed on threaded rods 24 and 26 respectively outside of the turnbuckle 12. Lock nuts 25 and 27 are threaded with the same "handedness" as their respective threaded rods 24 and 26 and have means to be manually rotated along the threaded rods. These means to manually rotate the lock nuts 25 and 27 ma be the standard flat sides of conventional nuts or may be a knurled or similar surface.

Figure 3:
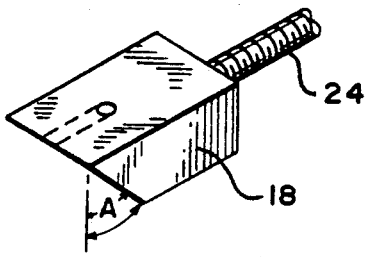
FIG. 3 is a side view of an end piece showing the angle of beveling.

End pieces 18 and 20 are attached to the threaded rods 24 and 26. In the preferred embodiment, threaded rods 24 and 26 are rigidly connected to end pieces 18 and 20 respectively. However, threaded rods 24, 26 may be connected to end pieces 18 and 20, respectively, through any of a number of well known and commercially available means for allowing end pieces 18 and 20 to pivot around the linear axis of threaded rods 24 and 26, until secured. As shown in FIG. 3, end pieces 18 and 20 have a beveled face 28 and 30, respectively. The angle of the beveling, "A", depends on the angle of the corner. For example, if the corner is a right angle, the bevel angle on both end faces 28 and 30 should be forty-five degrees. If the angle of the corner is some angle other than ninety degrees, the angle of the bevels can be determined by the following formula:

Angle of Beveling (A) = $\frac{1}{2}$ (180 degrees − the angle of the corner).

Extending through each of the end pieces 18 and 20, are apertures 32 and 34 respectively. These apertures extend entirely through end pieces 18 and 20, respectively, and are at a right angle to beveled end faces 28 and 30 respectively as is best seen in FIG. 3. Although end piece 18 is shown in FIG. 3, the corresponding structure of end piece 20 is the mirror image of FIG. 3. Apertures 32 and 34 have a diameter sufficient to allow either nails or screws or the like to extend through end pieces 18 and 20 and into the wall 5.

Extending through and perpendicular to turnbuckle 12 is a screw 36 which intermeshes with front threaded aperture 40 and rear threaded aperture 42 in turnbuckle 12. Screw 36 has a head 38 which serves a dual purpose. Head 38 allows the screw 36 to be manually turned so that head 38 moves closer or further away from turnbuckle 12. Head 38 may have flat, knurled, or similar sides to aid in manually turning screw 36. In addition, head 38 provides a stopper type catch for hanging wire from picture frames or the like which can be rested upon screw 36 and prevented from falling off by head 38. Alternatively, the object to be hung itself may have a void to receive the head 38. It is also possible to attach a hook or a swivel hook to screw 36 by means well known in the industry, either between head 38 and turnbuckle 12 or by extending screw 36 through head 38.

In operation, ends 18 and 20 are rotated about the linear axis of threaded rods 24 and 26 until the desired lineal length of the device is attained or until beveled faces 28 and 30 are a sufficient distance from each other that nails 22 inserted through apertures 32 and 34 can engage studs 7 within the wall 5 to support the device. If the wall is of the type that nails 22 will effectively support the device 10 at any place, then the ends 18 and 20 can be rotated about threaded rods 24 and 26 until a length of the device is achieved of the user's choice, depending upon such factors as the object to be hung, size of the object to be hung from the device, and aesthetic considerations of the user.

When the device is to be attached to the wall 5, the end pieces 18 and 20 are rotated so that the end faces 28 and 30 will come in contact with wall 5. Nails 22 are then driven through apertures 32 and 34 into wall 5 so that the heads of the nails 22 comes into contact with the end pieces 18 and 20 and holds the end pieces 18 and 20 in secure contact with wall 5.

Turnbuckle 12 may then be rotated in a direction to slightly separate end pieces 18 and 20 to put added frictional pressure on nails 22 so as to more securely hold end pieces 18 and 20 against the wall 5, and, to move screw 36 to the front of the device so as to be available for the hanging of an object. The optional lock nuts 25 and 27 may then be manually tightened against turnbuckle 12 to lock turnbuckle 12 into position with respect to the threaded rods 24 and 26. The screw 36 can then be adjustably screwed in or out of turnbuckle 12 by manipulating head 38 so as to most effectively position the object, once again with consideration to the size of the object to be hung and aesthetic considerations of the user.

Although the instant invention has been described in connection with its use in the corner between two walls, the invention is also intended to be used between different contours of a single curved wall. In addition, although nails have been described to attach the device to a wall, any other conventional fastening means such as screws or nuts and bolts may be used.

The instant invention has been shown and described herein in what is considered to be the most practical and preferred embodiment. While there have been described above the principles of this invention in connection with a specific apparatus, it is to be clearly understood that this description is made only by way of example and not as a limitation to the scope of the invention. It is recognized, that departures may be made therefrom within the scope of the invention and that obvious modifications will occur to a person skilled in the art.

What is claimed is:

1. An apparatus for hanging picture frames, plates, and the like in a corner between two walls comprising:

two end pieces, each having a beveled end disposed toward a respective wall and a non-beveled end disposed toward the other said end piece along a linear axis between each of said non-beveled ends, said non-beveled ends disposed perpendicular to said linear axis so that each of said beveled ends can contact a different wall in said corner;

means for moving said end pieces along said linear axis between said beveled ends, said means for moving said end pieces connected to each of said end pieces at said non beveled end of said end pieces;

means for attaching each of said end pieces to a wall along said beveled ends; and means, attached to said means for moving said end pieces, for supporting said picture frames, plates and the like, said means for supporting including a threaded aperture, in and perpendicularly disposed to said linear axis of said means for moving said end pieces and a screw, having a first end and a second end, said first end disposed to functionally intermesh with said threaded aperture, said screw having means for hanging an object attached to said screw at said second end, and said screw being adjustably positionable in said threaded aperture.

2. The apparatus of claim 1 wherein said means for moving said end pieces comprises:

a turnbuckle; and two rods, interconnected to said turnbuckle at opposite sides of said turnbuckle, at least one of said rods being threaded and threadably connected to said turnbuckle, each of said rods also connected to said respective non-beveled ends of said end pieces.

3. The apparatus of claim 1 wherein said means for moving said end pieces comprises:

a turnbuckle;

a threaded first rod, threadably connected to said turnbuckle and connected to said non-beveled end of one of said end pieces; and a threaded second rod, threadably connected to said turnbuckle opposite said first rod, the direction of threading of said second rod being in the opposite direction to the direction of threading of said first rod, said second rod connected to said non-beveled end of said end piece which is not connected to said first rod.

4. The apparatus of claims 2 or 3 further comprising at least one lock nut, each threadably connected to one of said threaded rods between said end piece and said turnbuckle, said lock nut having means for manual rotation about said threaded rod and having means to frictionally contact said turnbuckle thereby locking said turnbuckle in relative position to said threaded rod threadably connected to said lock nut.

5. The apparatus of claim 1 wherein said means for attaching each of said end pieces to a wall comprises:

apertures extending through each of said end pieces so that one end of each of said apertures extends through the beveled side of each of said beveled ends; and means for engaging the wall and said beveled ends of said end pieces simultaneously whereby said means for engaging the wall and said beveled ends draws said end pieces into firm and secure contact with said wall.

6. The apparatus of claim 5 wherein said means for engaging the wall and said beveled ends comprises screws.

7. The apparatus of claim 5 wherein said means for engaging the wall and said beveled ends comprises nails.

8. The apparatus of claim 1 wherein said threaded aperture extends through the body of said means for moving said end pieces.

9. The apparatus of claim 1 wherein said means for hanging an object comprises a hook.

10. The apparatus of claim 9 wherein said hook has means for swivelling about said second end of said screw.

11. An apparatus for hanging picture frames, plates, and the like in a corner between two walls comprising:

two end pieces, each having a beveled end disposed toward a respective wall and a non-beveled end disposed toward the other said end piece along a linear axis between each of said non-beveled ends, said non-beveled ends disposed perpendicular to said linear axis so that each of said beveled ends can contact a different wall in said corner;

means for moving said end pieces along said linear axis between said beveled ends, said means for moving said end pieces connected to each of said end pieces at said non-beveled end of said end pieces, said means for moving said end pieces comprising:

a turnbuckle;

a threaded first rod, threadably connected to said turnbuckle and connected to said non-beveled end of one of said end pieces; and a threaded second rod, threadably connected to said turnbuckle opposite said first rod, the direction of treading of said second rod being in the opposite direction to the direction of threading of said first rod, said second rod connected to said non-beveled end of said end piece which is not connected to said first rod;

means for attaching each of said end pieces to a wall along said beveled ends comprising:

apertures extending through each of said end pieces so that one end of each said apertures extends through the beveled side of each of said beveled ends; and means for engaging the wall and said beveled ends of said end pieces simultaneously whereby said means for engaging the wall and said beveled ends draws said end pieces into firm and secure contact with said wall; and, means, attached to said means for moving said end pieces, for supporting said picture frames, plates and the like, said means for supporting including a threaded aperture, in and perpendicularly disposed to said linear axis of said means for moving said end pieces and a screw, having a first end and a second end, said first end disposed to functionally intermesh with said threaded aperture, said screw having means for hanging an object attached to said screw at said second end, and said screw being adjustably positionable in said threaded aperture.

12. The apparatus of claim 11 further comprising at least one lock nut, each threadably connected to one of said threaded rods between said end piece and said turnbuckle, said lock nut having means for manual rotation about said threaded rod and having means to frictionally contact said turnbuckle thereby locking said turnbuckle in relative position to said threaded rod threadably connected to said lock nut.

13. The apparatus of claim 11 wherein said means for engaging the wall and said beveled ends comprises screws.

14. The apparatus of claim 11 wherein said means for engaging the wall and said beveled ends comprises nails.

15. The apparatus of claim 12 wherein said threaded aperture extends through the body of said means for moving said end pieces.

16. The apparatus of claim 12 wherein said means for hanging an object comprises a hook.

17. The apparatus of claim 16 wherein said hook has means for swivelling about said second end of said screw.

18. An apparatus for hanging picture frames, plates, and the like in a corner between two walls comprising:

(a) two end pieces, each having a beveled end disposed toward a respective wall and a non-beveled end disposed toward the other said end piece along a linear axis between each of said non-beveled ends, said non-beveled ends disposed perpendicular to said linear axis so that each of said beveled ends can contact a different wall in said corner;

(b) means for moving said end pieces along said linear axis between said beveled ends, said means for moving said end pieces connected to each of said end pieces at said non-beveled end of said end pieces, said means for moving said end pieces comprising:

a turnbuckle;

a threaded first rod, threadably connected to said turnbuckle and connected to said non-beveled end of one of said end pieces; and a threaded second rod, threadably connected to said turnbuckle opposite said first rod, the direction of treading of said second rod being in the opposite direction to the direction of threading of said first rod, said second rod connected to said non-beveled end of said end piece which is not connected to said first rod;

(c) means for attaching each of said end pieces to a wall along said beveled ends comprising:

apertures extending through each of said end pieces so that one end of each said apertures extends through the beveled side of each of said beveled ends; and means for engaging the wall and said beveled ends of said end pieces simultaneously whereby said means for engaging the wall and said beveled ends draws said end pieces into firm and secure contact with said wall;

(d) means, attached to said means for moving said end pieces, for supporting said picture frames, plates and the like comprising:

a threaded aperture, in and perpendicularly disposed to said linear axis of said means for moving said end pieces, said threaded aperture extending through the body of said means for moving said end pieces; and a screw, having a first end and a second end, said first end disposed to functionally intermesh with said threaded aperture, said screw having means for hanging an object attached to said screw at said second end, said means for hanging an object comprising a hook having means for swiveling about said second end of said screw and said screw being adjustably positionable in said threaded aperture along said threaded aperture.

* * * * *